US009617129B2

(12) United States Patent
Lautzenhiser et al.

(10) Patent No.: US 9,617,129 B2
(45) Date of Patent: Apr. 11, 2017

(54) HYDRAULIC PUMPING CYLINDER AND METHOD OF PUMPING HYDRAULIC FLUID

(75) Inventors: Lloyd L. Lautzenhiser, Verdi, NV (US); Wade Wolf, Belgrade, MT (US)

(73) Assignee: Brookefield Hunter, Inc., Belgrade, MT (US)

( * ) Notice: Subject to any disclaimer, the term of this patent is extended or adjusted under 35 U.S.C. 154(b) by 1759 days.

(21) Appl. No.: 13/049,590

(22) Filed: Mar. 16, 2011

(65) Prior Publication Data

US 2011/0227014 A1 Sep. 22, 2011

Related U.S. Application Data

(60) Provisional application No. 61/314,390, filed on Mar. 16, 2010.

(51) Int. Cl.
*B66F 3/24* (2006.01)
*B66F 5/04* (2006.01)
*B66F 3/42* (2006.01)

(52) U.S. Cl.
CPC . *B66F 5/04* (2013.01); *B66F 3/42* (2013.01)

(58) Field of Classification Search
USPC ..... 254/2 B–100, 93 R, 9 VA, 93 L, 93 H; 417/534, 553, 552, 551.1, 530
See application file for complete search history.

(56) References Cited

U.S. PATENT DOCUMENTS

| | | | | |
|---|---|---|---|---|
| 7,458,787 | B2 * | 12/2008 | Brown | 417/555.2 |
| 7,647,755 | B2 * | 1/2010 | Barnett et al. | 56/14.9 |
| 8,523,542 | B2 * | 9/2013 | Hofstatter | 417/553 |
| 2002/0079481 | A1 * | 6/2002 | Oxtoby | 254/93 H |
| 2005/0074349 | A1 * | 4/2005 | Hool et al. | 417/553 |
| 2007/0022750 | A1 * | 2/2007 | Bitter | 60/477 |
| 2008/0164449 | A1 * | 7/2008 | Gray et al. | 254/93 R |
| 2010/0186584 | A1 * | 7/2010 | Clucas | 92/143 |
| 2013/0091839 | A1 * | 4/2013 | Takahashi et al. | 60/517 |

* cited by examiner

*Primary Examiner* — Larry E Waggle, Jr.
*Assistant Examiner* — Nirvana Deonauth
(74) *Attorney, Agent, or Firm* — Taylor IP, P.C.

(57) ABSTRACT

A hydraulic jack includes a frame and a pump connected to the frame. The pump is connected to the frame. The pump includes a rod, a housing, and a piston, with hydraulic fluid being in the housing. The rod has a cross-sectional area and has a longitudinal axis. The housing has an end through which the rod slides. The housing has an interior open cross-sectional area in a direction normal to the longitudinal axis, and the housing has an interior wall. The piston is coupled to the rod. The piston establishes a rod side chamber and a piston side chamber within the housing. The piston has a cross-sectional area, which is smaller than the cross-sectional area of the housing thereby allowing a portion of the hydraulic fluid to flow between said piston and said interior wall to and from the rod side chamber and the piston side chamber when the piston is moved in the housing.

16 Claims, 2 Drawing Sheets

HYDRAULIC PUMPING CYLINDER AND METHOD OF PUMPING HYDRAULIC FLUID

CROSS REFERENCE TO RELATED APPLICATIONS

This is a non-provisional application based upon U.S. provisional patent application Ser. No. 61/314,390, entitled "HYDRAULIC PUMPING CYLINDER AND METHOD OF PUMPING HYDRAULIC FLUID", filed Mar. 16, 2010, which is incorporated herein by reference.

BACKGROUND OF THE INVENTION

1. Field of the Invention

The present invention relates to a hydraulic pumping cylinder, and, more particularly, to a low-load rapid fluid movement pumping cylinder.

2. Description of the Related Art

Hydraulic cylinders are common devices used in industry and for the jacking of loads using a jacking mechanism having a input cylinder and an output cylinder. The output cylinder is used to lift the load to a predetermined height with a considerably small force utilized on the mechanical portion that moves the input cylinder. The working principal of the hydraulic jack system provides for an applied small force that moves the input piston of a small cross-sectional area and pushes the hydraulic fluid or oil into an output cylinder, which then forces an output piston of large cross-sectional area to jack up a load.

The path of the input piston is often far longer than that of the output piston. The input piston must be repeatedly pumped to jack a load to a predetermined position. During the jacking process, each stroke of the input piston moves the output piston based upon the fluid transfer from the input cylinder to the output cylinder. Typically the same number of pumping strokes is needed to move the jack to a predetermined height regardless of whether there is a load on the output cylinder or not. Under the no-load condition the rate at which the ram of the output cylinder extends, directly or by way of a lifting arm, is not noticeably changed from the rate at which it travels under a loaded condition.

A disadvantage of the systems presently in use is that time and energy are wasted in moving the output piston/ram to the desired location or to encounter a load which is to be moved and/or lifted. Solutions utilized prior to the present invention typically utilize many hydraulic components, which are complex and expensive to manufacture, and due to the additional number of parts, are often unreliable.

What is needed in the art is an easy to operate and inexpensive to manufacture pumping cylinder system that moves a large quantity of hydraulic fluid under low pressure yet delivering high pressure when a load is encountered.

SUMMARY OF THE INVENTION

The present invention provides a hydraulic pumping cylinder.

The invention in one form is directed to a hydraulic jack including a frame and a pump connected to the frame. The pump is connected to the frame. The pump includes a rod, a housing and a piston, with hydraulic fluid being in the housing. The rod has a cross-sectional area and has a longitudinal axis. The housing has an end through which the rod slides. The housing has an interior open cross-sectional area in a direction normal to the longitudinal axis, and the housing has an interior wall. The piston is coupled to the rod.

The piston establishes a rod side chamber and a piston side chamber within the housing. The piston has a cross-sectional area, which is smaller than the cross-sectional area of the housing thereby allowing a portion of the hydraulic fluid to flow between said piston and said interior wall to and from the rod side chamber and the piston side chamber when the piston is moved in the housing.

An advantage of the present invention is that under a no-load or near no-load condition the pumping piston moves a large volume of hydraulic fluid as compared to when the fluid is under a high pressure resistance.

Another advantage of the present invention is that an output cylinder is rapidly moved under a no-load condition to thereby allow the output cylinder to rapidly engage a load to undertake the necessary work.

Yet another advantage of the present invention is that the apparatus is inexpensive to manufacture and can be readily adapted into systems currently using prior art designs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
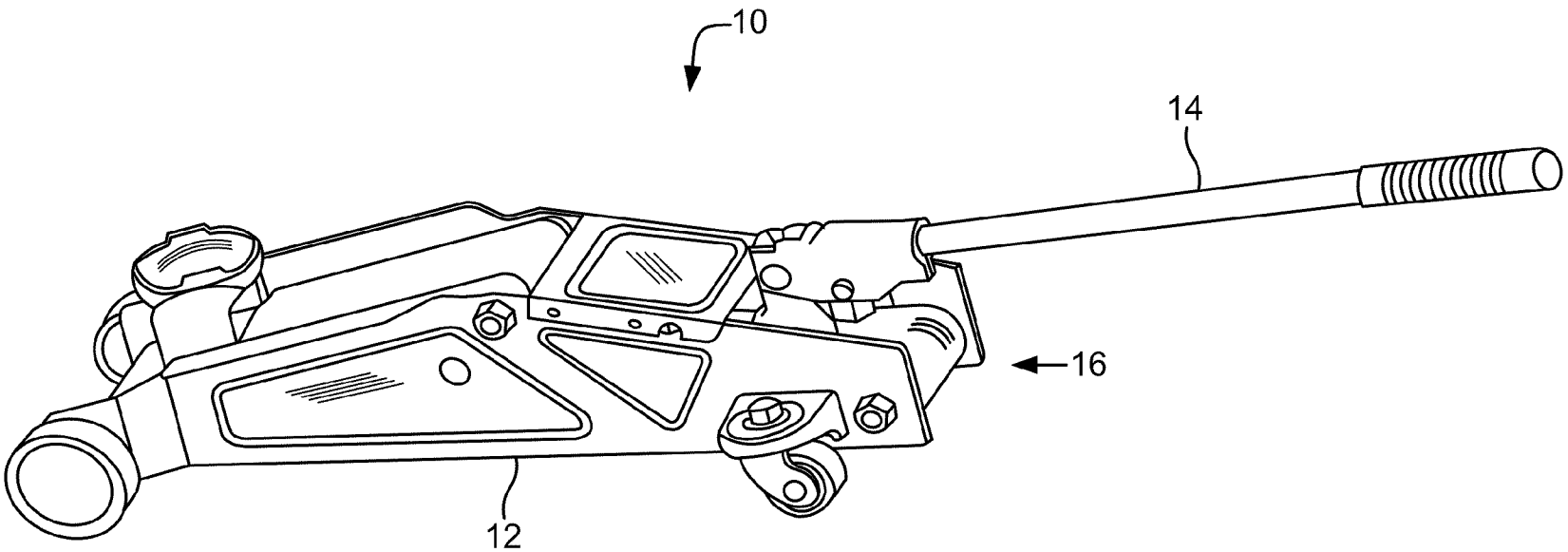
FIG. 1 illustrates an application of an embodiment of the present invention in the form of a manually operated hydraulic jack.

Referring now to the drawings, and more particularly to FIG. 1, there is shown a hydraulic jack 10 having a frame 12, a handle 14 and a hydraulic pump 16. Hydraulic jack 10 is similar on the exterior to numerous jack systems currently in use. Jack 10 is rolled under a device, such as a vehicle, and it is positioned so that the lifting arm will engage a portion of the underside of the car. Handle 14 is pumped up and down to actuate hydraulic pump 16, which is hydraulically linked to an output cylinder, not shown, that extends the lifting arm for the purpose of jacking the load, such as the vehicle. Hydraulic jack 10 may utilize any one of the embodiments to be described hereinafter as a hydraulic pump 16.

Figure 2:
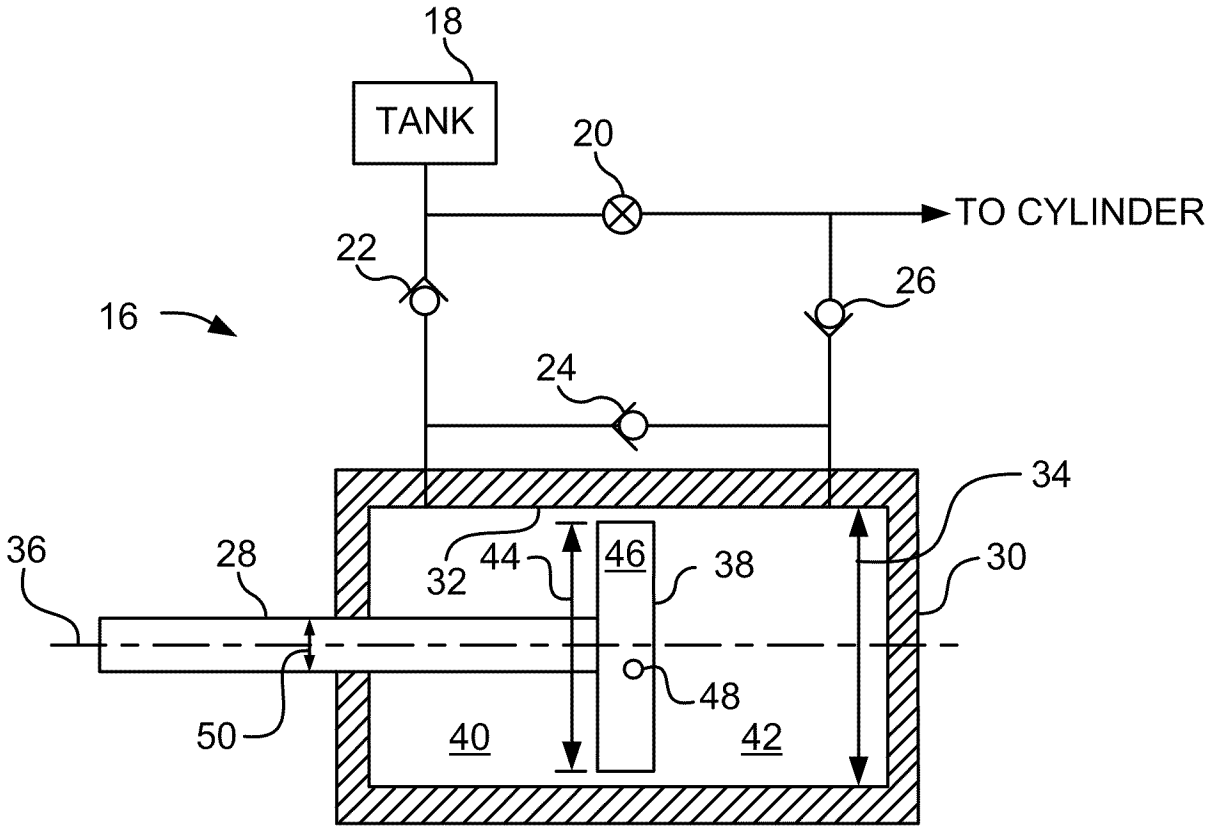
FIG. 2 is a partially schematicized and cross-sectional view of one embodiment of the present invention.

Now, additionally referring to FIG. 2 there is shown a hydraulic pump 16 that includes connections to a reservoir 18, a valve 20, check valves 22, 24 and 26, a shaft 28, a housing 30, and a piston 38, that operates within housing 30 having chambers 40 and 42 defined by the relative position of piston 38. Chamber 40 is herein referred to as a rod side or shaft side of the assembly and chamber 42 is herein referred to as a piston side of the assembly. Reservoir 18 holds hydraulic fluid that is pumped by way of hydraulic pump 16 to a working cylinder, not shown. Reservoir 18 may be vented to the air and allows a fluid flow into and out of reservoir 18 as directed by actions carried out by the positioning of valve 20 and pumping on handle 14. Valve 20 may be manually operated or under the control of an automatic control system. Valve 20 is opened to allow fluid flow from the work cylinder back into reservoir 18. Typically the fluid in the work cylinder, when it is under a load, is under pressure that has been built up by the operation of hydraulic pump 16.

Housing 30 has an interior wall 32 and a diameter 34. Although, for the sake of understanding of the present invention the interior of housing 30 is illustrated and discussed as being cylindrical and piston 38 as round, other shapes are contemplate as well. A longitudinal axis 36 is shown with it extending through rod 28 and housing 30. Piston 38 has a diameter 44 and a side 46, with hydraulic fluid being able to pass between interior wall 32 and side 46. Piston 38 may be centered around axis 36 and not come into contact with interior wall 32, but it is also contemplated to have bearings 48 or bearing surfaces 48, which may contact wall 32 to assist in keeping piston 38 centered in housing 30. The hydraulic fluid is free to flow between side 46 and wall 32 substantially around the entire circumference of piston 38.

Check valves 22, 24 and 26 allow for fluid to enter into housing 30 at appropriate times and to exit in a pressurized manner through check valve 26 to the work cylinder. Check valves 22, 24 and 26 may be spring biased to allow fluid flow through only in one direction.

Shaft 28, also known as a rod 28, is connected either directly to handle 14 or by way of a leveraging method utilized by those familiar with the art. Shaft 28 is hydraulically sealed where it enters into housing 30 and shaft 28 is slidingly engaged with housing 30 allowing shaft 28 to enter and exit in a longitudinal direction of shaft 28. Hydraulic lines are shown schematically entering through portions of housing 30 and may be appropriately positioned along end portions of housing 30 or along the sides thereof. The actual positioning of the hydraulic lines is not limited by the positions shown in the figure and their positions are merely for the ease of illustration and explanation of the present invention.

Piston 38 is slidable substantially parallel to the interior walls of housing 30. The shape of piston 38 may correspond to the interior shape of housing 30, which is typically a cylindrical shape, although other shapes are also possible. In a similar fashion shaft 28 is typically of a cylindrical nature although other shapes are also contemplated.

In the operation of pumping pump 16, shaft 28 is withdrawn to the left toward the inner housing wall of housing 30. In this position chamber 40 is much smaller than chamber 42. Force is applied to shaft 28 pushing it further into housing 30 causing piston 38 to advance with shaft 28. As shaft 28 continues to move into housing 30, chamber 40 increases in size causing fluid to travel from reservoir 18 through check valve 22 into chamber 40. Fluid in chamber 42 is forced through the hydraulic line and through check valve 26 and is sent to the work cylinder. This cycle can be repeated with shaft 28 being moved longitudinally into and out of housing 30 causing large transfers of fluid to the work cylinder. When shaft 28 is moved out of housing 30, check valve 26 is closed and check valves 24 and 22 are open to allow for transfer of fluid into chamber 42. When shaft 28 is being moved out from housing 30 hydraulic fluid is transferred from chamber 40 to chamber 42. The hydraulic fluid is introduced through check valve 22 since the overall displacement within housing 30 is being reduced since shaft 28 is being removed through the wall of housing 30.

When the work cylinder encounters a load, pressure in the line increases and as shaft 28 is further inserted into housing 30 the pressure in chamber 42 is such that a significant amount of the hydraulic fluid flows past piston 38 in housing 30. As shaft 28 continues to enter into housing 30, shaft 28 displaces an amount of fluid that corresponds to the volume of shaft 28 that is moved into housing 30 to thereby providing for two different pumping volumes. The volume of fluid moved in this high pressure mode is based on the relative cross-sectional area of shaft 28 rather than on the cross-sectional area of piston 38.

The non-sealed nature of piston 38 with housing 30 allows for some fluid to move from chamber 42 to chamber 40, when operating under low pressure conditions, but with most of the flow going through check valve 26. Although the schematic illustration show a gap extending around all sides of piston 38, other configurations are also contemplated, such as contact along one side of housing 30, or a groove in housing 30 with piston 38 being otherwise substantially sealed with housing 30. During high pressure operation a substantial amount of fluid will flow between chamber 42 and 40 due to the "leaky" nature of the fit of piston 38 with housing 30. It is during this high pressure operation that the high pressure output of pump 16 is due to the movement of shaft 28 into housing 30.

The ratio between the surface area of piston 38 and the area of the leak around piston 38 is selected so that the switch between the low pressure mode to the high pressure mode takes place at a desirable pressure. The viscosity of the fluid may coact with this ratio to determine the pressure at which pump 16 transitions from low-to-high and high-to-low pressure. It is also contemplated that a temperature compensation device, which can be in the form of a temperature sensitive valve might be used to counter any change in the fluid flow relative to temperature changes of the fluid. Further, piston 38 and/or housing 30 can be fabricated from a material having a coefficient of expansion that, in combination, compensates for a change of viscosity of the fluid. For example, the piston can be fabricated from a material with a higher coefficient of expansion than housing 30 to compensate for a change in viscosity of the fluid. A specific example is a piston 38 made of Nylon 6/6 and housing 30 made of steel. Alternately, a fluid with a near constant viscosity over an extended temperature range, such as Chevron Rando® HD can be used.

It was determined that a gap between side 46 and wall of 32 of at least 0.005 inches is preferred and that a gap of at least 0.0075 is more preferred. In one embodiment of the present invention a housing diameter 34 of 2.000 inches was selected, with a piston diameter 44 of 1.985 inches and a rod diameter 50 of 0.625 inches was used. The fluid used was Chevron Rando® HD oil with a viscosity index of 200. The ratio of the cross sectional area of piston 38 to the cross sectional area of chambers 40 and 42 for this one embodiment are related, in this example, to be the ratio of the square of the two radii, or 0.985. This ratio may be thought of one which is not to be exceeded, or a value in a range of between approximately 0.99 and 0.95. The ratio between the cross sectional area of piston 38 to the cross sectional area of rod 28 is 10.09, or approximately 10. This means as pump 16 transitions to it's high pressure mode that it has 10 times the pressure generating capacity than when it is in the low pressure mode. The advantage also exists in the low pressure mode that pump 16 moves 10 times as much fluid, allowing the working cylinder to advance to an encountered load much faster than the prior art.

It is also contemplated to select the aforementioned ratios to correspond with desired pump capacities. For example, the selection of ratios for a 1 ton jack would vary from the selection for a 10 ton jack so that the input forces on handle 14 might be comparable and yet they may also have similar low pressure ram extension capabilities. It is also contemplated to select the hydraulic fluid and the ratios so that the properties of the fluid and the gap between piston side 46 and wall 32 are optimized.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic jack, comprising:

a frame; and a pump connected to said frame, said pump including:

a rod having a cross-sectional area, said rod having a longitudinal axis;

a housing having an end through which said rod slides, said housing having an interior open cross-sectional area in a direction normal to said longitudinal axis, said housing having an interior wall, said rod being hydraulically sealed with said housing where said rod enters said housing;

hydraulic fluid in said housing; and a piston coupled to said rod, said piston establishing a rod side chamber and a piston side chamber within said housing, said piston having a cross-sectional area, said cross-sectional area of said piston being smaller than said cross-sectional area of said housing thereby allowing a portion of said hydraulic fluid to flow between said piston and said interior wall to and from said rod side chamber and said piston side chamber when said piston is moved in said housing.

2. The hydraulic jack of claim 1, wherein said piston has a side, a distance existing between said side of said piston and said interior wall along substantially the entire surface of said side.

3. The hydraulic jack of claim 2, wherein said distance is at least 0.005 inches.

4. The hydraulic jack of claim 3, wherein said distance is at least 0.0075 inches.

5. The hydraulic jack of claim 1, wherein a ratio of said cross sectional area of said piston to said cross sectional area of said housing is no more than 0.985.

6. The hydraulic jack of claim 1, wherein a ratio of said cross sectional area of said piston to said cross sectional area of said housing is between 0.99 and 0.95.

7. The hydraulic jack of claim 1, wherein a ratio of said cross sectional area of said piston to said cross sectional area of said rod is approximately 10.

8. A hydraulic pump, comprising:

a rod having a cross-sectional area, said rod having a longitudinal axis;

a housing having an end through which said rod slides, said housing having an interior open cross-sectional area in a direction normal to said longitudinal axis, said housing having an interior wall, said rod being hydraulically sealed with said housing where said rod enters said housing;

hydraulic fluid in said housing; and a piston coupled to said rod, said piston establishing a rod side chamber and a piston side chamber within said housing, said piston having a cross-sectional area, said cross-sectional area of said piston being smaller than said cross-sectional area of said housing thereby allowing a portion of said hydraulic fluid to flow between said piston and said interior wall to and from said rod side chamber and said piston side chamber when said piston is moved in said housing.

9. The hydraulic pump of claim 8, wherein said piston has a side, a distance existing between said side of said piston and said interior wall along substantially the entire surface of said side.

10. The hydraulic pump of claim 9, wherein said distance is at least 0.005 inches.

11. The hydraulic pump of claim 10, wherein said distance is at least 0.0075 inches.

12. The hydraulic pump of claim 8, wherein a ratio of said cross sectional area of said piston to said cross sectional area of said housing is no more than 0.985.

13. The hydraulic pump of claim 8, wherein a ratio of said cross sectional area of said piston to said cross sectional area of said housing is between 0.99 and 0.95.

14. The hydraulic pump of claim 8, wherein a ratio of said cross sectional area of said piston to said cross sectional area of said rod is approximately 10.

15. The hydraulic jack of claim 1, wherein said pump is configured to pump said hydraulic fluid at a first volume of said fluid at a first pressure and a second volume of said fluid at a second pressure, said first volume being larger than said second volume, said first pressure being lower than said second pressure.

16. The hydraulic pump of claim 8, wherein said pump is configured to pump said hydraulic fluid at a first volume of said fluid at a first pressure and a second volume of said fluid at a second pressure, said first volume being larger than said second volume, said first pressure being lower than said second pressure.

* * * * *